428-911
11/2/82 XR 4,356,569

United States Patent [19]

Sullivan

[11] 4,356,569

[45] Nov. 2, 1982

[54] ARMORED SKIN DIVING SUIT

[76] Inventor: Jeremiah S. Sullivan, 1105 Sunset Cliffs, San Diego, Calif. 92107

[21] Appl. No.: 209,387

[22] Filed: Nov. 24, 1980

[51] Int. Cl.[3] ..... F41H 1/02

[52] U.S. Cl. ..... 2/2.5; 428/911

[58] Field of Search ..... 2/2.1 R, 2.5, 2; 428/911; 9/330, 331

[56] References Cited

U.S. PATENT DOCUMENTS 2,819,759 1/1958 Goodloe ..... 2/2.5 X 3,284,806 11/1966 Prasser ..... 2/2.5 X 3,398,406 8/1968 Waterbury ..... 2/2.5

3,813,281 5/1974 Burgess et al. ..... 2/2.5 X

*Primary Examiner*—Richard J. Scanlan, Jr.

*Attorney, Agent, or Firm*—Brown & Martin

[57] ABSTRACT

A suit is provided having a flexible garment portion which mounts thereon, preferably at spaced intervals, a plurality of armor elements. The suit can be incorporated with a conventional wetsuit construction, or the armor can be imbedded in a chain mail garment worn exteriorly of a wetsuit.

3 Claims, 7 Drawing Figures

ARMORED SKIN DIVING SUIT

BACKGROUND OF THE INVENTION

The existence of the vast array of inventions in the fields of diving suits and diving bells bears witness to the fascination and interest people have had in the diving arts. In the early days of diving history, divers were encapsulated in airtight rigid metal suits similar to a knight in armor. The diving suit was similar to a diving bell, but provided some articulation at the joints. The interior of the suit was maintained dry and fresh air was pumped from the surface through hoses.

Thanks principally to the work of Jacques Cousteau, and others following his lead, the SCUBA, or self-contained underwater breathing apparatus was developed to the point where it has replaced rigid shell devices such as armor-type suits and bathyspheres except in very deep waters. Although providing the diver with a great deal of flexibility, a disadvantage inherent in the use of the modern wetsuit and scuba equipment is the vulnerability of the diver to ocean predators, primarily sharks.

It is a known fact that sharks will generally test their potential prey prior to biting down to determine how hard the surface of the potential next meal is. If the shark's teeth strike a hard surface, particularly a hard metal surface, the shark will ordinarily back off. Although suits of armor and license plates have been found in the stomachs of sharks, the creature actually prefers meals that are softer and easier to chew.

To avoid accommodating the shark's mealtime proclivities, while at the same time preserving the skindiver's body flexibility, mesh suits have been provided such as are disclosed in U.S. Pat. No. 3,284,806 issued in 1966. However, mesh suits of this type, especially when the mesh is imbedded inside a layer of rubber foam material, although possibly providing some resistance to actual penetration of the suit with the teeth of smaller sharks, nevertheless is incapable of providing any serious resistance from attack, at least when used in gauges adequately fine to provide any reasonable degree of flexibility at all to the diver. Shark teeth penetrate through imbedded mesh.

SUMMARY OF THE INVENTION

The present invention accomodates the need for something which will deter the larger sharks by providing a suit having a base garment which is either chain mail or rubber foam wetsuit material, and into which are imbedded a multiplicity of hard shield elements strategically positioned in the garment material so that no conflict exists with the articulation of the human body. In its preferred embodiment, sizable plastic shields are imbedded directly into the mesh of a mesh garment such that the materials coalesce into a tough, hard, lobster-like exterior shell, both resistant to the tearing and slashing of teeth because of the steel mesh, and effective as well in deterring shark attacks because of the hardness of the exterior surface. The mesh is also preferred because the slight galvanic currents caused by immersion of the metallic mesh in salt water is also, at times, effective in deterring sharks.

The shield elements, which are in the disclosed embodiment made of plastic, and which are heated to merge with the mesh, may sandwich with the mesh in the middle or may be adhered to form one side or the other of the mesh. In a slight modification of the invention, the shield elements are made as interlocking geometric shapes varying in size and positioned to cover substantially all of the surface area of the suit and are imbedded into the foam of a wetsuit, thereby providing the hard, deterring action of the shield elements without the strength of the mesh and at the same time distributing pressure of any bite over a larger area to prevent bone breakage.

DETAILED DESCRIPTION OF THE DRAWINGS

Figure 1:
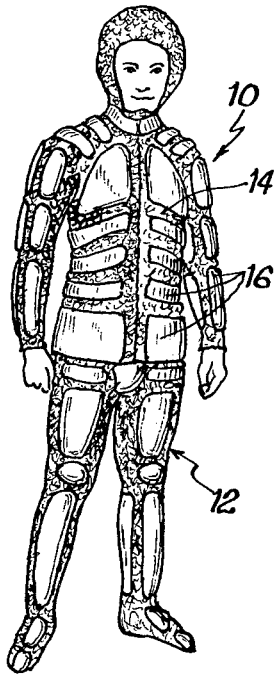
FIG. 1 is an illustration of a diver wearing the suit in its preferred embodiment and illustrating the positioning of the shield elements.
Figure 2:
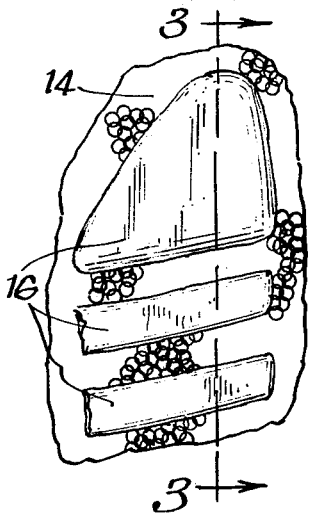
FIG. 2 is a front elevational view of a detail of FIG. 1.
Figure 3:
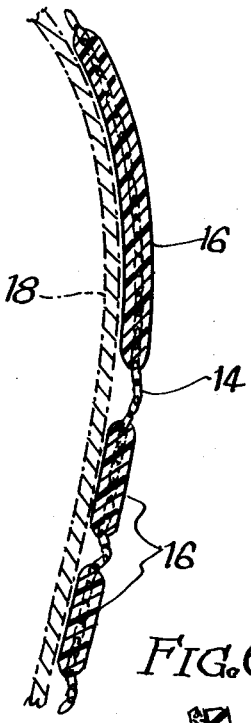
FIG. 3 is a section taken along line 3—3 of FIG. 2.

A diver is shown in FIG. 1 in one embodiment of the suit of the instant invention comprising vest portion 10 and bottom portion 12. This particular embodiment is ordinarily to be worn over a conventional wetsuit and comprises chain mail 14, shown best in FIGS. 2 and 3, onto which is engaged at spaced intervals shield elements 16 which, according to the preferred method of construction, are made of tough, high impact plastic. These shield elements ordinarily would be provided in plainar form, possibly on both sides of the mesh, and heated so that they meld together to form a kind of sandwich as shown in FIG. 3. Additionally, the shield elements should assume the general contour of the human body as shown in that figure. The shield elements thus offer high resistance to a shark attack while permitting the articulation of the body at the interplate-spanning links of the mesh. As can be seen from FIG. 1, the normal articulation of the body is such that the shield elements on the front of the torso are generally parallel to the axis of bending of the torso, whereas, due to the rigid links of the arms and legs between articulations, the shield elements on the limbs are generally perpendicular to the axis of the bending of the limbs, extending parallel instead of perpendicular to the limb.

Figure 4:
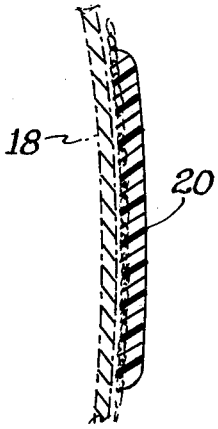
FIG. 4 is a section similar to that of FIG. 3 but of a slight modification of the suit construction.
Figure 5:
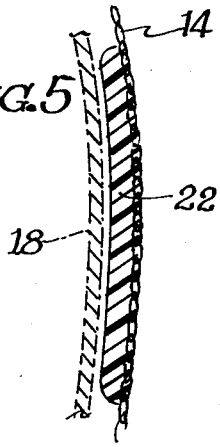
FIG. 5 is a section of the suit similar to that of FIG. 4 but with the shield elements on the inside of the mesh.

In FIGS. 4 and 5, a modification of the suit is provided wherein shield elements 20 are clad to the exterior of the metal mesh or mail 14, again probably best being adhered to the mesh by heating and forming around the individual links of the chain mail. FIG. 5 is identical to the embodiment of FIG. 4 except that shield elements are defined on the interior side of the mesh suit.

In these embodiments, sizable plastic plates are imbedded directly into the mesh of a mesh garment such that they harden around the mesh and protrude slightly to function well in deterring shark attacks because of the hardness of the exterior surface. The mesh is also preferred because the slight galvanic currents caused by immersion of the metallic mesh in salt water is also, at times, effective in deterring sharks.

The shield elements, which in the disclosed embodiment are made of plastic, and which are heated to merge with the mesh, may sandwich with the mesh in the middle or may be adhered to form one side or the other of the mesh. In a slight modification of the invention, the shield elements are made of interlocking geometric shapes varying in size and positioned to cover substantially all of the surface area of the wet suit, and are imbedded into the foam of a wetsuit, thereby providing the hard, deterring action of the shield elements without the strength of the mesh and at the same time distributing pressure of any bite over a larger area to prevent bone breakage.

Figure 6:
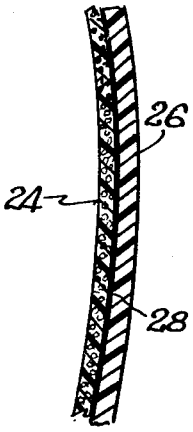
FIG. 6 is a section similar to the prior figures except that the shield elements are bonded directly onto the rubber foam with no mesh being present.

In FIG. 6, a wetsuit 24 actually mounts directly hard plastic shield elements 26 adhered with a bonding layer 28. Although the absence of the chain mail would naturally reduce the resistance to tearing action of shark's teeth, it also would reduce the weight and emphasize the flexibility of the suit while preserving the hardness provided by the shield elements.

Figure 7:
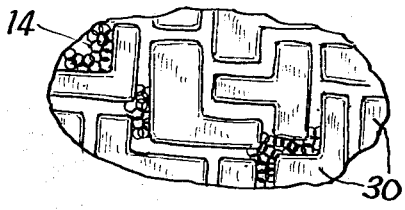
FIG. 7 is an elevational view of the mesh and shield element configuration wherein the shield elements are differently sized overlapping geometric shapes.

In FIG. 7 the mesh is again used and in this embodiment the exterior surface of the mesh is clad with disc shield elements 30 preferably bonded in the same fashion as the shield elements 20 and 22. The advantage of utilizing these small interlocking geometric shield elements, which as can be seen in FIG. 7 are of various sizes, is that a shield pattern, as shown, can be established which generally occupies substantially all the surface area of the mesh and yet the shield elements need not be individually positioned into the suit as they would have to be in the embodiment of FIG. 1. In fact, the material of the suit as shown in FIG. 7 could probably be manufactured and subsequently cut to form the suit substantially according to conventional clothing manufacturing techniques, a possibility which is absent according to the construction of the embodiment of FIG. 1 wherein individual shield elements are tailored to a specific location on the suit.

In all of the embodiments presented, the essential ingredient is the provision of a hard, shark-resistant layer of tough shield elements protruding slightly for direct contact by a shark, coupled with the flexibility and lightweight characteristics of a wetsuit. The incorporation of a light chain mail adds the additional feature of tear resistance, as well as some additional hardness in the inter-shield spaces, and adds the feature of deterrence by galvanic current, which is a significant advantage.

What is claimed is:

1. A shark deterring suit comprising:

a flexible garment, a plurality of rigid shield elements bonded to said garment substantially covering the surface area thereof, and said garment comprises a chain mail garment and said rigid shield elements are plastic molded at spaced intervals on said garment sandwiching said chain mail centrally of said shield elements.

2. A shark deterring suit comprising:

a flexible garment, a plurality of rigid shield elements bonded to said garment substantially covering the surface area thereof, and said garment is made of chain mail and said shield elements are plastic with said mesh imbedded in one side thereof.

3. A shark deterring suit comprising:

a flexible garment, a plurality of rigid shield elements bonded to said garment substantially covering the surface area thereof, said shield elements are small geometric shapes of interlocking planform imbedded in said garment in mutually spaced relation, and said garment is mesh and said geometric elements are variably sized distributed over the surface of said mesh to occupy the substantial surface area thereof.

* * * * *